US007275975B2

(12) United States Patent
Trageser et al.

(10) Patent No.: US 7,275,975 B2
(45) Date of Patent: Oct. 2, 2007

(54) TOY VEHICLE WITH ON-BOARD ELECTRONICS

(75) Inventors: Mark Trageser, Los Angeles, CA (US); Alan Wei, Chai Wan (HK); Angus Wong, Pokfulam (HK); Ng Chun Chin, Ma On Shan (HK)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/422,033

(22) Filed: Jun. 2, 2006

(65) Prior Publication Data

US 2007/0004311 A1 Jan. 4, 2007

Related U.S. Application Data

(60) Provisional application No. 60/687,375, filed on Jun. 3, 2005.

(51) Int. Cl.
*A63H 17/00* (2006.01)

(52) U.S. Cl. ..... 446/435; 446/465

(58) Field of Classification Search ..... 446/440, 446/448; 180/65.5
See application file for complete search history.

(56) References Cited

U.S. PATENT DOCUMENTS

| | | | |
|---|---|---|---|
| 2,800,329 | A | 7/1957 | Tinsley |
| 2,896,708 | A | 7/1959 | Bair |
| 3,546,668 | A | 12/1970 | Legler et al. |
| 3,618,397 | A | 11/1971 | Bosley et al. |
| 3,652,937 | A | 3/1972 | Garrott |
| 3,942,114 | A | 3/1976 | Keeling |
| 4,237,648 | A | 12/1980 | Moe et al. |
| 4,247,107 | A | 1/1981 | Smith, III et al. |
| 4,265,047 | A | 5/1981 | Meyer et al. |
| 4,280,300 | A | 7/1981 | Kulesza et al. |
| 4,292,758 | A | 10/1981 | Kuna et al. |
| 4,330,127 | A | 5/1982 | Brand et al. |
| 4,349,196 | A | 9/1982 | Smith, III et al. |
| 4,364,566 | A | 12/1982 | Neuhierl |
| 4,451,911 | A | 5/1984 | Klose et al. |
| 4,479,650 | A | 10/1984 | Neuhierl |
| 4,946,416 | A | 8/1990 | Stern et al. |
| 4,964,837 | A | 10/1990 | Collier |

(Continued)

FOREIGN PATENT DOCUMENTS

| | | |
|---|---|---|
| WO | 96/15837 | 5/1996 |

(Continued)

*Primary Examiner*—Robert E. Pezzuto
*Assistant Examiner*—Alex F. R. P. Rada
(74) *Attorney, Agent, or Firm*—Kolisch Hartwell, P.C.

(57) ABSTRACT

A toy vehicle that measures and displays performance characteristics is presented. The toy vehicle may be configured to measure performance of the toy, such as speed or acceleration, and display a value for the performance characteristic. A display for showing the performance values may be mounted on the body of the toy vehicle. Movement of the toy vehicle may be measured using an accelerometer. The toy vehicle may determine the number of wheel rotations in a set period of time using a rotary encoder. The value of the performance characteristic may be output to a microprocessor onboard the toy vehicle. The microprocessor may use the value in calculations and the result of the calculations, such as a scaled speed value, may be shown on the display screen.

25 Claims, 5 Drawing Sheets

U.S. PATENT DOCUMENTS

| | | | | |
|---|---|---|---|---|
| 5,306,197 | A | 4/1994 | Watanabe | |
| 5,637,996 | A | 6/1997 | McDarren et al. | |
| 5,692,956 | A | 12/1997 | Rifkin | |
| 5,855,483 | A | 1/1999 | Collins | |
| 5,928,058 | A | 7/1999 | Francis et al. | |
| D426,215 | S | 6/2000 | Whalen | |
| 6,155,928 | A | 12/2000 | Burdick | |
| 6,200,219 | B1 | 3/2001 | Rudell et al. | |
| 6,293,798 | B1 | 9/2001 | Boyle et al. | |
| 6,354,842 | B1 | 3/2002 | Frei | |
| 6,461,238 | B1 | 10/2002 | Rehkemper et al. | |
| 6,688,985 | B2 | 2/2004 | Weiss et al. | |
| D492,685 | S | 7/2004 | Vlcek | |
| 2001/0045978 | A1 | 11/2001 | McConnell et al. | |
| 2002/0142701 | A1 | 10/2002 | Rosenberg | |
| 2002/0187725 | A1 | 12/2002 | Yamaguchi et al. | |
| 2003/0010545 | A1* | 1/2003 | Takeuchi | 180/6.28 |
| 2003/0188594 | A1 | 10/2003 | Levin et al. | |
| 2004/0032395 | A1 | 2/2004 | Goldenberg et al. | |
| 2004/0077285 | A1 | 4/2004 | Bonilla et al. | |
| 2004/0224740 | A1 | 11/2004 | Ball et al. | |
| 2005/0064936 | A1 | 3/2005 | Pryor | |
| 2006/0183405 | A1* | 8/2006 | Matthews | 446/456 |

FOREIGN PATENT DOCUMENTS

| | | |
|---|---|---|
| WO | 02/078810 | 10/2002 |
| WO | 04/033247 | 4/2004 |

* cited by examiner

TOY VEHICLE WITH ON-BOARD ELECTRONICS

CROSS-REFERENCES

This application claims priority to U.S. Provisional Application Ser. No. 60/687,375, filed Jun. 3, 2005, and entitled "Toy Vehicle with On-Board Electronics," incorporated herein by reference.

BACKGROUND

The present disclosure relates generally to toy vehicles with on-board electronics, and more specifically to toy vehicles incorporating electronics to record and display data related to the performance of the toy vehicle.

Examples of known toy vehicles are disclosed in U.S. Pat. Nos. 2,800,329, 2,896,708, 3,546,668, 3,618,397, 3,652,937, 3,942,114, 4,237,648, 4,247,107, 4,265,047, 4,280,300, 4,292,758, 4,330,127, 4,349,196, 4,364,566, 4,479,650, 4,451,911, 4,946,416, 4,964,837, 5,306,197, 5,637,996, 5,692,956, 5,855,483, 5,928,058, 6,155,928, 6,200,219, 6,293,798, 6,354,842, 6,461,238, 6,688,985, D426,215, D492,685 and published U.S. patent application Ser. Nos. US2001/0045978, US2002/0142701, US2002/0187725, US2003/0188594, US2004/0032395, US2004/0077285, US2004/0224740, US2005/0064936, WO199615837, WO2002078810, WO2004033247. The disclosures of all of these patents and publications are incorporated herein by reference.

SUMMARY

A toy vehicle of the present disclosure may be rolled by children on flat surfaces, down inclines or along flexible tracks and may not use motors or other power sources for motion. A toy vehicle may include electronic sensors such as rotary optical encoders or accelerometers that monitor motion of the vehicle or monitor motion of a wheel of the vehicle. The toy vehicle may be used to simulate racing and the displayed data may be used to compare vehicle speed with other similar toy vehicles or with other runs of the same vehicle.

The data recorded by the sensors may be used to perform calculations relating to the motion or speed of the vehicle. The recorded data and/or results of the calculations may be made available to the user The data may be displayed on a Liquid Crystal Display ("LCD") as part of the toy, a remote LCD screen, through Light Emitting Diodes ("LEDs"), through an audio output such as a speaker, or even through a conventional computer output device by plugging the vehicle into the computer or by plugging removable memory from the vehicle into the computer.

Values calculated and displayed may include speed, distance traveled, length of time of travel and acceleration ("G Force"). Some embodiments of the toy vehicle may include keys or control inputs that allow the user to change what information is displayed.

The advantages of the present invention will be understood more readily after a consideration of the drawings and the Detailed Description of the Preferred Embodiment.

DETAILED DESCRIPTION

Figure 1:
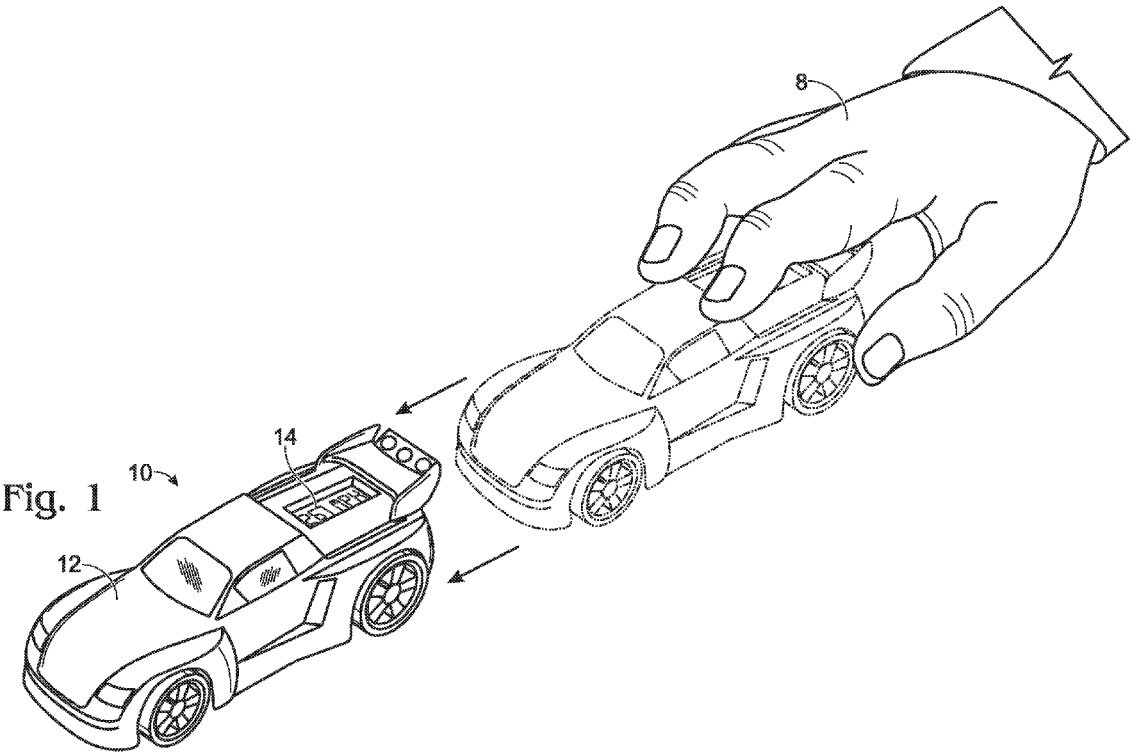
FIG. 1 is a perspective view of a user rolling a toy vehicle on the floor showing a display incorporated in the car body indicating the calculated speed.

Referring to FIG. 1, a user 8 is shown rolling a toy vehicle 10 on the floor. Toy vehicle 10 includes a body housing 12 in the form of a car body and a display 14. Display 14 shows a speed corresponding to the vehicle velocity. The speed displayed may not be the actual speed of toy vehicle 10 but may correspond to the speed of a full scale vehicle.

Figure 2:
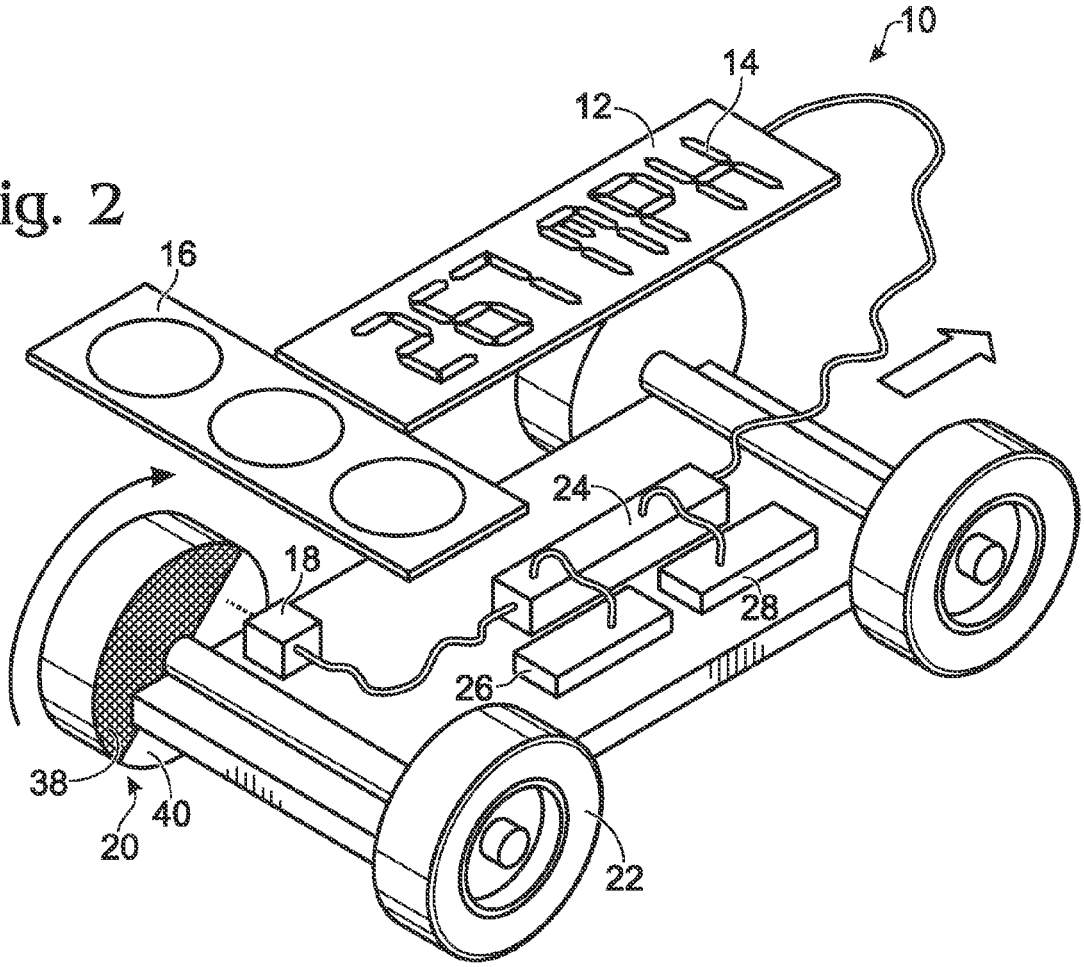
FIG. 2 is a perspective view of the toy vehicle of FIG. 1 with the body cutaway showing wheels with an encoder pattern on one wheel, an encoder, a microprocessor, a power supply, control inputs and a display with a calculated speed.

Referring to FIG. 2, a toy vehicle 10 similar to FIG. 1 is shown with body housing 12 cut away to show functional components. Similar numbering is used for clarity in this and subsequent figures as in the previous figure. Toy vehicle 10 again includes display 14 and also shows control inputs 16, a motion sensor 18, an encoder pattern 20, a wheel 22, a microprocessor 24, a power supply 26 and memory 28. Display 14, motion sensor 18, power supply 26 and memory 28 are operably connected to microprocessor 24. Motion sensor 18 may be an accelerometer 30 or a rotary encoder 32.

A user playing with toy vehicle 10 may push the vehicle across the floor as fast as possible to achieve the highest possible speed. In some applications, multiple users may race their toys by giving them an initial velocity and releasing them side by side. Toy vehicle 10 may travel down an incline to gain speed. Users may try to attain the highest speed or acceleration possible with the data displayed on toy vehicle 10.

Wheel 22 rotates as toy vehicle 10 moves. Wheel rotations may be detected and counted by rotary encoder 32. Rotary encoder 32 may incorporate a light source 34, a detector 36 and encoder pattern 20.

Encoder pattern 20 may be printed on wheel 22. Encoder pattern 20 may comprise contrasting patterns of a black section 38 and a white section 40. Encoder pattern 20 may rotate in front of light source 34 and detector 36. Light from light source 34 may be reflected from the surface of encoder 20. Black section 38 and white section 40 of encoder pattern 20 may reflect different amounts of light. Detector 36 may differentiate the amount of light reaching it from light source 34.

Where encoder pattern 20 is on the surface of wheel 22, encoder pattern 20 rotates with wheel 22. When white section 40 is proximate to encoder 32, it reflects more light from source 34 which may cause detector 36 to emit an 'ON' signal. Black section 38 may reflect less light than white section 40 and may result in detector 36 emitting an 'OFF' signal.

Where encoder pattern 20 comprises only one white section 40 and one black section 38, each rotation will result in detector 36 emitting an 'ON' signal once. Each 'ON' signal will indicate one rotation at microprocessor 24. Light source 34 and detector 36 may comprise a single unit. Light source 34 may be an LED.

Figure 3:
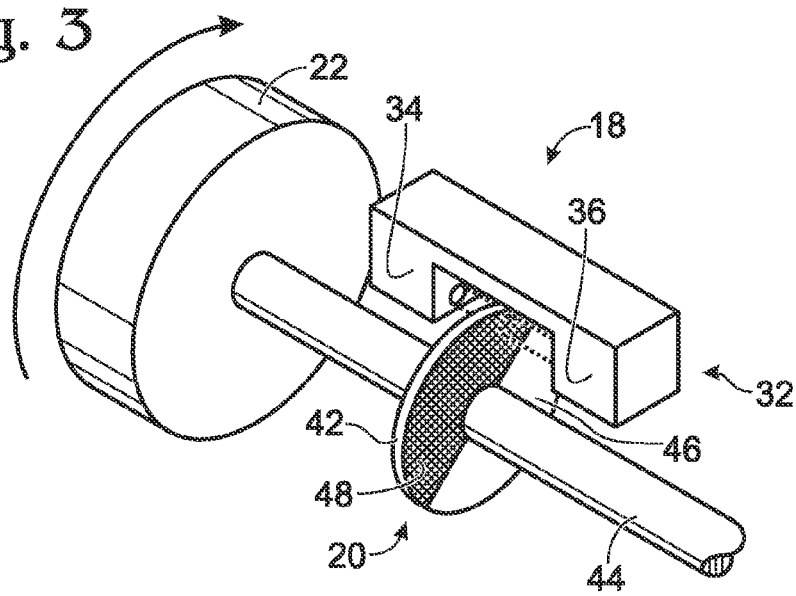
FIG. 3 is a diagram of an alternate configuration of a rotary encoder including a light source and detector on opposite sides of a disk, the disk with opaque sections and transparent sections.

In FIG. 3, an alternate embodiment of rotary encoder 32 is shown including light source 34, detector 36 and disk 42. Disk 42 may be mounted on an axle 44 and comprise encoder pattern 20. Disk 38 may have clear section 46 and an opaque section 48. Light source or emitter 34 and detector 36 may be mounted on opposite sides of disk 38 such that light only reaches detector 36 when clear section 46 of disk 42 is between source 34 and detector 36.

Where encoder pattern 20 comprises one clear section and one opaque section of disk 38, each rotation will result in detector 36 emitting an 'ON' signal once. Each 'ON' signal will indicate one rotation. Disk 38 may have multiple clear sections separated by opaque sections.

These encoder pattern configurations are examples and should not be construed as limitations. Any encoder pattern configured to operate with rotary encoder 32 may be used and still fall within the scope of this disclosure.

Microprocessor 24 may count the number of distinct 'ON' values transmitted by encoder 32 over a set period of time. The wheel circumference may be programmed into microprocessor 24 and the distance traveled may be calculated using the wheel circumference. If the wheel circumference is 2 centimeters (cm) and there are 50 rotations in a second, the distance traveled by toy vehicle 10 is 100 cm and the toy vehicle velocity is 100 cm per second. A velocity of 100 cm per second is equivalent to 3.6 kilometers per hour.

Microprocessor 24 may be further programmed to multiply this value by the scale of vehicle 10. For example, if toy vehicle 10 is a scale model ⅓ $2^{nd}$ the size of a real car, the speed displayed may be 115 kilometers per hour. Microprocessor 24 may further convert this value to other units such as miles per hour and display a speed of 71 miles per hour. The reported speed value may be saved into memory 28. The speed value may be shown on display 14.

Figure 4:
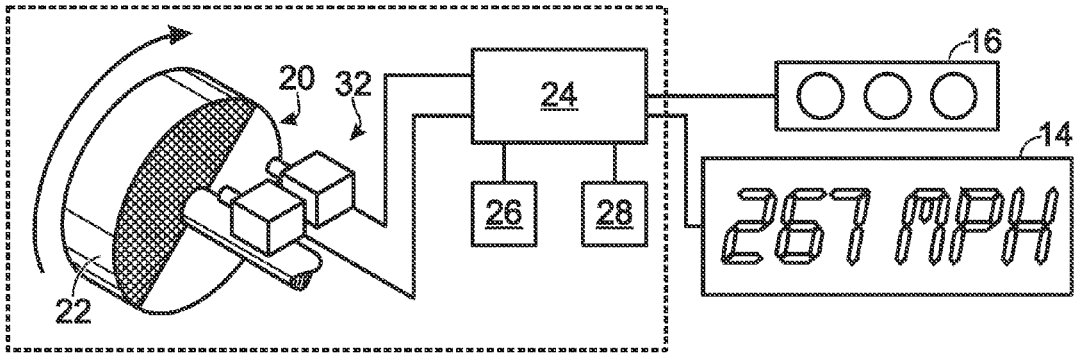
FIG. 4 is a block diagram of the functional components of the toy vehicle of FIGS. 1 and 2 showing an encoder, a microprocessor, memory, a power supply, control inputs and a display showing a calculated speed.

Referring to FIG. 4, a block diagram of the functional components of toy vehicle 10 is shown. Toy vehicle 10 again includes display 14, microprocessor 24, power supply 26, memory 28 and optical rotary encoder 32 including encoder pattern 20. Rotation of encoder pattern 20 may be detected by rotary encoder 32 and sends a digital signal to microprocessor 24. Microprocessor 24 converts the digital signals to an appropriate value to be sent to display 14. Control inputs 16 may be used to configure microprocessor 24. Toy vehicle 10 may include discrete memory unit 28.

In an alternate configuration, motion sensor 18 may be an accelerometer 30. A single axis accelerometer may determine acceleration in one direction, such as by measuring the deflection of a cantilever beam on an integrated circuit chip. The chip may include means for measuring the deflection of the beam and transmitting that data from the chip as an electronic signal. Other methods of determining acceleration may also be used.

Figure 5:
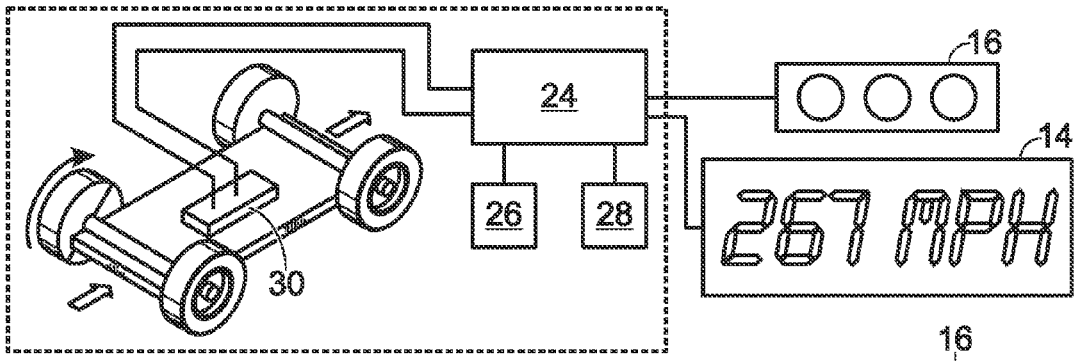
FIG. 5 is a block diagram of the functional components of an alternate embodiment of the toy vehicle of FIGS. 1 and 2 showing an accelerometer, a microprocessor, memory, a power supply, control inputs and a display with a calculated speed.

Referring to FIG. 5, a block diagram shows the functional components of an alternate configuration of toy vehicle 10. Toy vehicle 10 includes display 14, microprocessor 24, power supply 26 and accelerometer 30.

In this example, accelerometer 30 may be supported by housing 12 and configured to measure the acceleration resulting from moving the car forwards and backwards. Data sent from accelerometer 30 may be received by microprocessor 24. Microprocessor 24 may determine a speed value at any point in time from the measured acceleration and send the speed value to display 14.

Microprocessor 24 may convert the acceleration data from accelerator 30 to the required units and format to be sent to display 14. Control inputs 16 may be used to configure the functions of microprocessor 24.

Microprocessor 24 may use the information from rotary encoder 32 or accelerometer 30 to determine other toy vehicle performance measures. Microprocessor 24 may determine elapsed time to reach a certain speed. Microprocessor 24 may also determine if the current speed value is higher than a highest or maximum speed value stored in memory and may replace a current speed value in memory.

Control input 16 may comprise keys. The keys may be used to change a mode of play for the toy vehicle or the keys may be used to reset values stored in memory 28 or on microprocessor 24. Keys may include a mode key 38, a reset key 40 and a unit key 42.

Toy vehicle 10 may have several functional configurations for recording and reporting toy vehicle performance. Mode key 38 may be used to select from a plurality of modes such as Try Me mode, Speed Test mode, Highest Speed mode, and Time-trial mode. Reset key 40 may be used to clear and reset the display contents. Unit key 42 may be used to change a display unit of measure. In some embodiments, the selectable units of display may include M/h (miles per hour), km/h (kilometers per hour), or Rev/s (revolution per second).

In Try Me mode, the current speed of the car may be displayed. In this mode, the internal electronics of vehicle 10 may use the information obtained by the rotary encoder 32 or accelerometer 30 to calculate the current speed of the vehicle. If the current speed calculated is higher than the highest speed record, then the current speed may be stored in the highest speed record. Reset key 40 may have no function in this mode.

The user may select Speed Test Mode using Mode key 38. The Speed Test mode may display the highest speed of the current run. The speed displayed may be different than the speed stored in memory as the highest speed. If the speed displayed in Speed Test Mode is higher than the value stored in memory 28 as the highest speed, the new higher speed value may be replaced with the lower speed value in memory.

In Highest Speed Mode, display 14 may show the maximum speed attained. The user may press Reset key 40 in this mode to clear the maximum speed record to zero. When vehicle 10 is in Highest Speed Mode toy vehicle 10 may only display memory contents and motion sensor 18 may be turned off.

The speed value unit of measure may be selected by pressing Unit key 42. For example, pressing the Unit key may change the display from units of Miles per Hour to Kilometers per Hour.

Time-Trial Mode measures the time it takes for vehicle 10 to reach a predetermined speed, for example the time duration in ms (milliseconds) it takes for vehicle 10 to travel from 0 mph to 100 mph. The time may be displayed in increments of 250 ms per step until the speed of 100 mph is reached. When vehicle 10 is in Time Trial Mode, electronic motion sensor 18 may be turned on. The time displayed may increment in tenths of a second.

The decimal point on display 14 may be represented by an underscore. Pressing Reset key 40 may ready the on-board electronics for another time trial by clearing the LCD screen to zero. Unit key 42 may have no function in Time Trial mode.

Some embodiments of vehicle 10 may also include an auto shut down function. The internal electronics of toy vehicle 10 may automatically shut down to save power when not in use for a predetermined length of time, such as one minute. Display 14 and microprocessor 24 may be turned off on system shut down. Additionally, display 14 may dim when a battery requires replacement or an icon may appear.

In some embodiments of vehicle 10, there may be default game play settings and default display settings when the toy is first turned on. For example, the default mode of play may be Current Speed Mode, the default display may be 0000, and the default maximum speed recorded may be 0000.

Referring again to the example depicted in FIG. 1, display 14 has three numeric digits to display speed and at least one icon or set of alphabetic, such as Mph, to indicate the unit of measure of display 14. Alternative embodiments of vehicle 10 may include more digits and icons to display information. In an alternate embodiment of vehicle 10, display 14 consists of four digits used for display of a digital number and an icon in front of the digital number indicating the mode and/or unit in use, such as M/hr, km/hr, etc. Display 14 may have four digits for display of a digit number and seven icons for display of unit or mode.

The mode selected may be displayed in an upper segment of display 14 above the four digit number When in Try Me mode, Speed Test mode, Highest Speed mode or Time Trial mode, display 14 may display "TRY", "TEST", "MAX", and "0-100" respectively. The display unit selected may be displayed in a side segment to the right of the four digit number. When in miles per hour, kilometers per hour, or revolutions per minute, display 14 may show "MPH", "KPH", and "REV" respectively.

Figure 6:
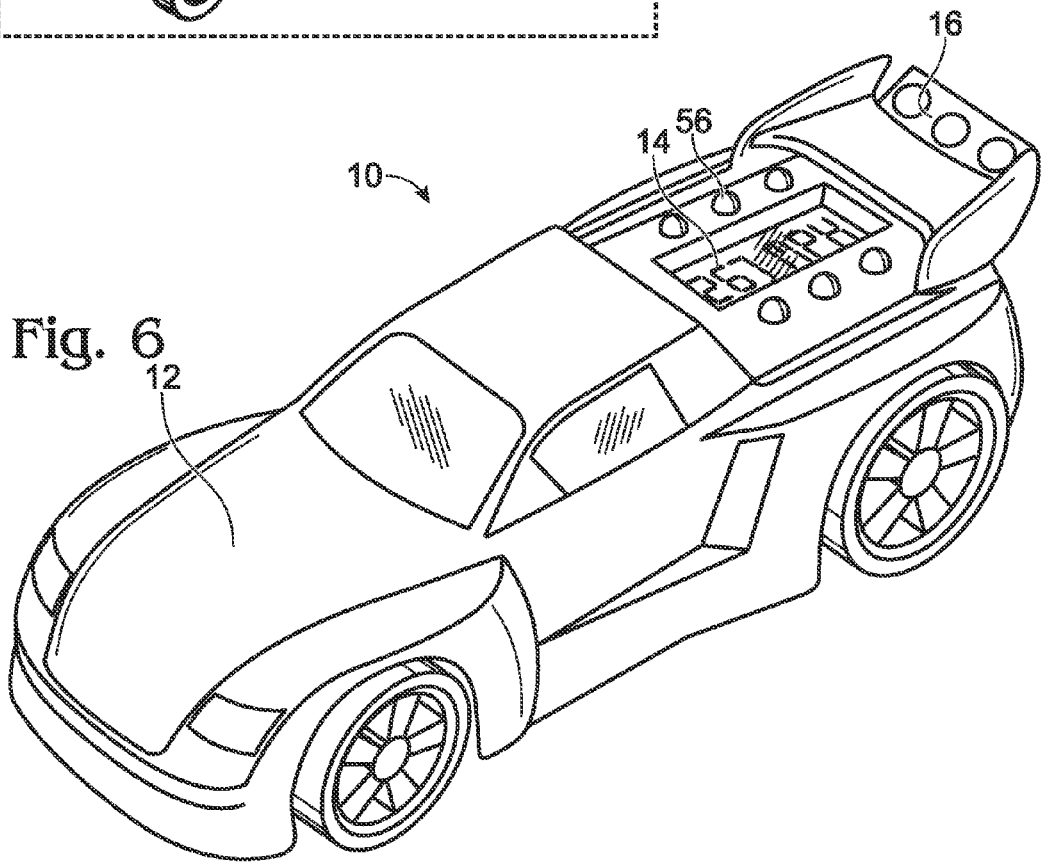
FIG. 6 is a perspective view showing an alternative configuration of a toy vehicle including LED lights associated with the engine, a display incorporated into the engine area and three user control inputs behind the engine.

Referring to FIG. 6, a toy vehicle 10 is shown in an alternate configuration with a representation of an engine visible and LED lights as part of the engine representation. The engine representation also incorporates display 14. Control inputs 16 may be located behind the engine.

Figure 7:
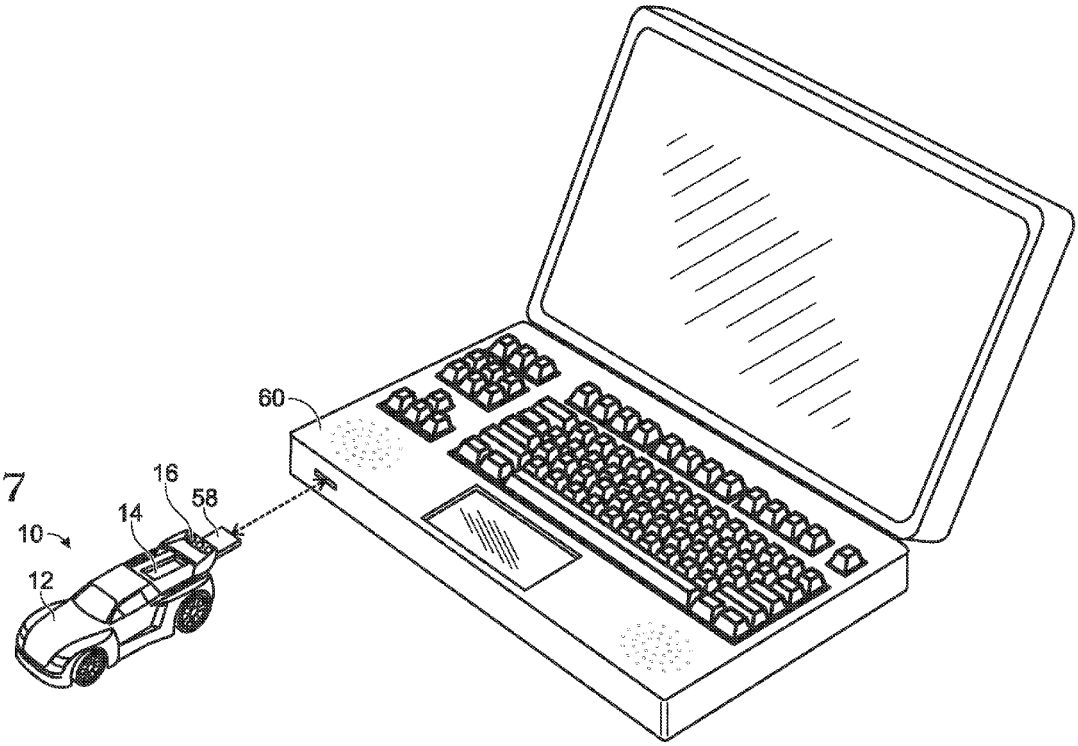
FIG. 7 is a perspective view showing an alternative configuration of a toy vehicle including a connector extending from the vehicle and the connector being plugged into a computer to transfer information between the vehicle and the computer.

Referring to FIG. 7, a toy vehicle 10 is shown with a USB connector 44 located at the rear portion of vehicle 10. Vehicle 10 may include body 12 and display 14. USB connector 44 may be used to connect to a computer 200. Data from vehicle 10 may be uploaded to computer 200, and data from computer 200 may be downloaded to vehicle 10. Computer 200 may display data uploaded from vehicle 10, calculated information uploaded from vehicle 10, or calculated information determined using data uploaded from vehicle 10.

In an alternate embodiment, vehicle 10 may include a speaker. Vehicle 10 may download audio files from computer 200 and play the audio files during acceleration or at other times during play.

In an alternate embodiment, vehicle 10 may record multiple measurements of vehicle performance and save the measurements to memory 28. For example, vehicle 10 may record speed of vehicle 10 every second for 20 seconds as vehicle 10 travels along a track. The results may be downloaded from memory 28 to computer 200. Computer 200 may create a graphical chart displaying the collected speed values.

These configurations are presented as examples and should not be construed as limitations. Connector 44 may be a different kind of connector or comprise a cable. Connector 44 could be a wireless link such as a link using infrared or radio communication. Command inputs may comprise more or fewer buttons. Similarly, display configurations, play modes and encoders described here are examples only and should not be considered limitations. Other configurations than those presented which perform similar functions are within the scope of this disclosure.

Figure 8:
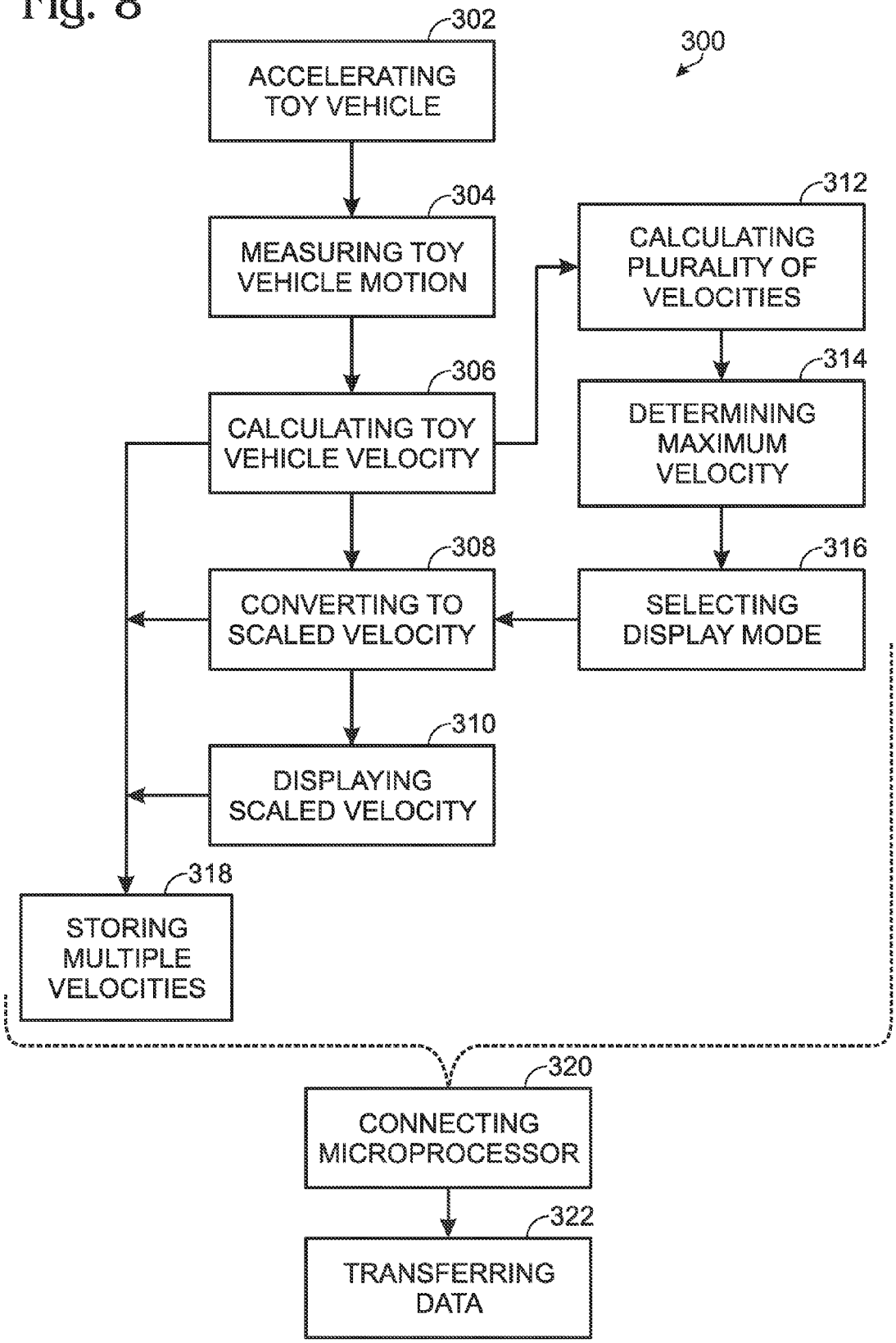
FIG. 8 is a flowchart showing an example of a method of measuring velocity of a toy vehicle, such as the toy vehicle of FIG. 1.

The foregoing disclosure details several possible methods of measuring the velocity of a reduced-scale toy vehicle, such as toy vehicle 10. Some examples of such methods are shown in FIG. 8 and indicated generally at 300. Box 302 includes accelerating a toy. Box 304 includes measuring toy motion from onboard the toy, for example by a rotary encoder (such as an optical rotary encoder), an accelerometer, and so forth, as detailed above. In one example, toy motion in only one direction may be measured. Box 306 includes calculating toy velocity from the measurements, as explained above. Box 308 includes converting the calculated velocity to a scaled velocity, for example by multiplying the calculated velocity to a scaled vehicle velocity by multiplying the calculated velocity by a factor corresponding to the scale of the vehicle. Box 310 includes displaying the scaled vehicle velocity on the toy vehicle, such as on a LCD display.

Optionally, methods may further include further steps, indicated in boxes 312, 314, and 316, respectively, of calculating a plurality of toy vehicle velocities during acceleration, determining a maximum toy vehicle velocity from the calculated toy vehicle velocities, and selecting a display mode to display the determined maximum toy vehicle velocity value. Another optional step of storing multiple calculated toy vehicle velocity values in memory onboard the toy vehicle is indicated in box 318. Optional steps of connecting a microprocessor to a computer and transferring data between the toy vehicle and the computer are indicated in boxes 320, 322.

Other methods may include fewer or more steps than those shown in 300. For example, some methods may include displaying the calculated toy vehicle velocity without converting the calculated velocity to a scaled toy vehicle velocity. Such methods, or other methods, may include steps in a different order than as illustrated in FIG. 8. All of such variations are considered to be within the scope of this disclosure.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in this or a related application. Such new claims, whether they are directed to a different invention or directed to the same invention, whether different, broader, narrower or equal in scope to the original claims, are also regarded as included within the subject matter of the inventions of the present disclosure.

We claim:

1. A toy vehicle comprising:

a housing configured to resemble a reduced-scale vehicle;

at least one freely rotatable wheel supporting the housing and configured to rotate when the vehicle moves along an external surface;

a display disposed on an exterior surface of the housing for displaying a velocity value;

a rotary encoder configured to count rotations of the freely rotatable wheel and output encoder data representative of the rotation count; and a microprocessor configured to calculate toy vehicle velocity from the encoder data and to send a velocity value to the display.

2. The toy vehicle of claim 1 where the rotary encoder includes an encoder pattern configured to rotate with the at least one wheel, and the rotary encoder counts wheel rotation.

3. The toy vehicle of claim 1 where the display is a liquid crystal display.

4. The toy vehicle of claim 1 where the value displayed is the velocity of the toy multiplied by a scale factor corresponding to the reduced scale of the toy vehicle.

5. The toy vehicle of claim 1 further comprising memory operably connected to the microprocessor.

6. The toy vehicle of claim 1 further comprising a connector, operably connected to the microprocessor, configured to connect the microprocessor to a personal computer and transfer data between the microprocessor and personal computer.

7. The toy vehicle of claim 1 further comprising at least one control input.

8. A toy vehicle comprising:

a housing configured to resemble a reduced-scale vehicle;

a display disposed on an exterior surface of the housing for displaying a speed;

an accelerometer for measuring vehicle motion; and a microprocessor configured to:

calculate toy vehicle velocity from measured vehicle motion; and send a velocity value to the display.

9. The toy vehicle of claim 8 where the accelerometer is a Micro Electro Mechanical System.

10. The toy vehicle of claim 8 further comprising memory for storing program instructions and values.

11. The toy vehicle of claim 8 further comprising a connector configured to connect the microprocessor to a personal computer.

12. The toy vehicle of claim 8 further comprising at least one control input.

13. A speedometer to be used in a reduced-scale toy vehicle having a body supported on at least one freely rotatable wheel that rotates when the vehicle is moved along a support surface, the speedometer comprising:

an optical rotary encoder, including an encoder pattern, configured to count rotation of the freely rotatable wheel;

control inputs;

a display on the toy vehicle;

a power source; and a microprocessor, operably connected to the control inputs, the encoder, the display and the power source, the microprocessor configured to determine and display a value based on counted wheel rotation.

14. The toy speedometer of claim 13 where the display is a liquid crystal display.

15. The toy speedometer of claim 13 where the value displayed is the speed of the toy vehicle multiplied by a scale factor corresponding to the reduced scale of the toy vehicle.

16. The toy speedometer of claim 13 further comprising memory operably connected to the microprocessor.

17. The toy speedometer of claim 13 further comprising a connector configured to connect the microprocessor to a personal computer for transferring data between the microprocessor and personal computer.

18. A method of measuring velocity of a reduced-scale toy vehicle, comprising:

accelerating a reduced-scale toy vehicle;

measuring toy motion from onboard the toy vehicle;

calculating toy vehicle velocity from the measurements;

converting the calculated velocity to a scaled vehicle velocity by multiplying the calculated velocity by a factor corresponding to the reduced scale of the toy vehicle; and displaying the scaled vehicle velocity on the toy vehicle.

19. The velocity measuring method of claim 18 where toy motion is measured by an accelerometer.

20. The velocity measuring method of claim 18 where toy motion is measured by an optical rotary encoder.

21. The velocity measuring method of claim 18 where toy motion in only one direction is measured.

22. The velocity measuring method of claim 18 further comprising calculating a plurality of toy vehicle velocities during acceleration, determining a maximum toy vehicle velocity from the calculated toy vehicle velocities, and selecting a display mode to display the determined maximum toy vehicle velocity value.

23. The velocity measuring method of claim 18 further comprising storing a toy vehicle velocity value in memory onboard the toy vehicle.

24. The velocity measuring method of claim 18 further comprising storing multiple calculated toy vehicle velocity values in memory onboard the toy vehicle.

25. The velocity measuring method of claim 18 further comprising:

connecting a microprocessor to a computer; and transferring data between the toy vehicle and the computer.

* * * * *